US007882816B2

(12) United States Patent
Eichenberger et al.

(10) Patent No.: US 7,882,816 B2
(45) Date of Patent: Feb. 8, 2011

(54) AIR STARTER ENGAGEMENT SYSTEM

(75) Inventors: David A. Eichenberger, Sanford, NC (US); Richard L. Caviness, Robbins, NC (US)

(73) Assignee: Ingersoll Rand Company, Montvale, NJ (US)

( * ) Notice: Subject to any disclaimer, the term of this patent is extended or adjusted under 35 U.S.C. 154(b) by 0 days.

(21) Appl. No.: 12/419,056

(22) Filed: Apr. 6, 2009

(65) Prior Publication Data

US 2010/0251985 A1 Oct. 7, 2010

(51) Int. Cl.
*F02N 7/00* (2006.01)

(52) U.S. Cl. ..... 123/179.31

(58) Field of Classification Search ..... 123/179.31, 123/179.24, 179.28

See application file for complete search history.

(56) References Cited

U.S. PATENT DOCUMENTS

| | | | |
|---|---|---|---|
| 3,182,650 | A | 5/1965 | Heckt |
| 3,791,365 | A | 2/1974 | Pharr et al. |
| 3,794,009 | A | 2/1974 | Wenrich et al. |
| 4,126,113 | A | 11/1978 | Sarro et al. |
| 4,170,210 | A | 10/1979 | Janik, Jr. |
| 4,273,085 | A | 6/1981 | Janik, Jr. |
| 4,324,212 | A | 4/1982 | Samuel et al. |
| 4,495,905 | A | 1/1985 | Morishita et al. |
| 4,679,533 | A | 7/1987 | Klie et al. |
| 4,694,791 | A | 9/1987 | Tanaka |
| 4,699,095 | A | 10/1987 | Klie et al. |
| 4,747,270 | A | 5/1988 | Klie et al. |
| 5,255,644 | A | 10/1993 | Mills et al. |
| 5,267,539 | A | 12/1993 | Becker et al. |

FOREIGN PATENT DOCUMENTS

| | | | |
|---|---|---|---|
| GB | 2025533 | A | 1/1980 |

OTHER PUBLICATIONS

International Search Report and Written Opinion, dated Apr. 8, 2010, PCT/US2010/022840, 9 pages.

*Primary Examiner*—Hai H Huynh
(74) *Attorney, Agent, or Firm*—Michael Best & Friedrich LLP

(57) ABSTRACT

A method of starting an engine with an engine starter that includes pressurizing a motor supply chamber with a fluid, selectively pressurizing an actuating chamber in response to the pressure in the motor supply chamber, moving a first valve along a first axis in response to pressure in the actuating chamber and moving a pinion toward engagement with the engine in response to movement of the first valve. The method further includes further pressurizing the actuating chamber, moving a second valve along a second axis in response to the further pressure in the actuating chamber, rotating the pinion in response to movement of the second valve, meshing pinion teeth with teeth on the engine, and starting the engine in response to rotation of the pinion.

20 Claims, 10 Drawing Sheets

AIR STARTER ENGAGEMENT SYSTEM

BACKGROUND

The present invention relates to air-powered engine starters that move a pinion into engagement with a bull gear.

SUMMARY

In one embodiment, the invention provides an engine starter operable to initiate operation of an engine under the influence of motive fluid from a motive fluid source. The engine starter includes a motor operable in response to a flow of motive fluid, a drive train coupled to the motor for operation with the motor and a pinion coupled to the motor via the drive train for rotation about a pinion axis in response to operation of the motor. The engine starter further includes a first valve having a first spring and a first moveable portion, the first moveable portion is coupled to the pinion and is moveable with the pinion along a first valve axis between a retracted position in which the pinion is spaced from the engine and an extended position in which the pinion engages a portion of the engine. The first spring biases the first moveable portion into the retracted position. The engine starter further includes a second valve having a second spring and a second moveable portion. The second valve is positioned between the motive fluid source and the motor. The second moveable portion is moveable along a second valve axis between a closed position, in which communication between the motive fluid source and the motor is inhibited, such that the motor is not operating, and an open position in which communication between the motive fluid source and the motor is permitted, such that the motive fluid is permitted to flow through the motor to initiate operation of the motor and therefore rotation of the pinion. The second spring biases the second moveable portion to the closed position. The first moveable portion moves from the retracted position to the extended position prior to movement of the second moveable portion from the closed position to the open position, such that the pinion moves along the axis prior to rotating about the axis.

In one embodiment, the invention provides an engine starter operable to initiate operation of an engine under the influence of motive fluid from a source of motive fluid. The engine starter includes a motor operable under the influence of the motive fluid to operate a gear train, a motor supply chamber in constant communication with the source of motive fluid. A first valve includes a first working surface and a first stem extending along a first valve axis, the first valve is supported for movement along the first valve axis between retracted and extended positions. A pinion is coupled to the first valve. A first portion of the pinion is in meshing engagement with the gear train and a second portion of the pinion adapted to move out of engagement with respect to a portion of the engine in response to the first valve being in the retracted position and into engagement with respect to a portion of the engine in response to the first valve being in the extended position. The pinion rotates in response to the motor driving rotation of the gear train. A second valve includes a second working surface facing the first working surface and a second stem extending along a second valve axis that is collinear with the first valve axis. The second valve is supported for movement along the second axis between open and closed positions. A sealing member is within the motor supply chamber and is coupled for movement with the second valve. The sealing member closes communication between the motor supply chamber and the motor in response to the second valve being in the closed position, and opens communication between the motor supply chamber and the motor in response to the second valve being in the open position. An actuating chamber is at least partially defined by the first and second working surfaces. A master valve operates between an open condition in which the master valve opens communication between the source of motive fluid and the actuating chamber, and a closed condition in which the master valve closes communication between the source of motive fluid and the actuating chamber and places the actuating chamber in communication with exhaust. A first biasing member biases the first valve toward the retracted position. The first biasing member deflects in response to a first force applied to the first valve. A second biasing member biases the second valve toward the closed position, the second biasing member deflecting in response to a second force applied to the second valve. The second force is higher in magnitude than the first force. Actuating the master valve into the open condition pressurizes the actuating chamber with motive fluid, and exposure of the motive fluid to the first and second working surfaces initially gives rise to the first force on the first and second valves, resulting in deflection of the first biasing member and movement of the first valve from the retracted position toward the extended position. Cessation of movement of the first valve toward the extended position and the pressure of motive fluid in the actuating chamber give rise to the second force against the second working surface, resulting in deflection of the second biasing member and movement of the second valve from the closed position toward the open position, such that the sealing member opens communication between the motor supply chamber and the motor. Opening communication between the motor supply chamber and the motor causes the motor to operate under the influence of the motive fluid to drive rotation of the gear train and rotation of the pinion to initiate operation of the engine.

In another embodiment the invention provides a method of starting an engine with an engine starter that includes pressurizing a motor supply chamber with a fluid, selectively pressurizing an actuating chamber in response to the pressure in the motor supply chamber, moving a first valve along a first axis in response to pressure in the actuating chamber and moving a pinion toward engagement with the engine in response to movement of the first valve. The method further includes further pressurizing the actuating chamber, moving a second valve along a second axis in response to the further pressure in the actuating chamber, rotating the pinion in response to movement of the second valve, meshing pinion teeth with teeth on the engine, and starting the engine in response to rotation of the pinion.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
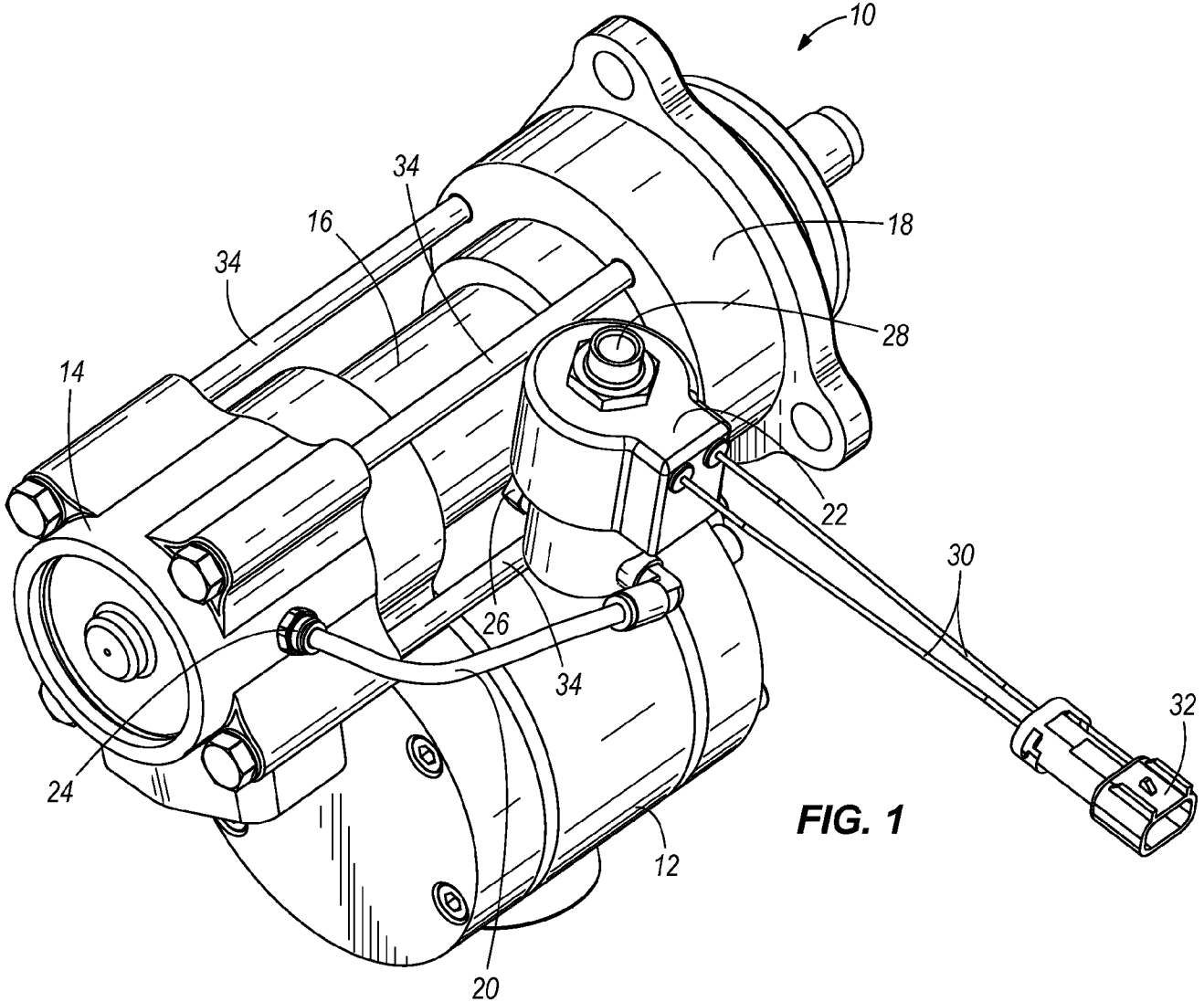
FIG. 1 is a first perspective view of an air-powered engine starter.
Figure 2:
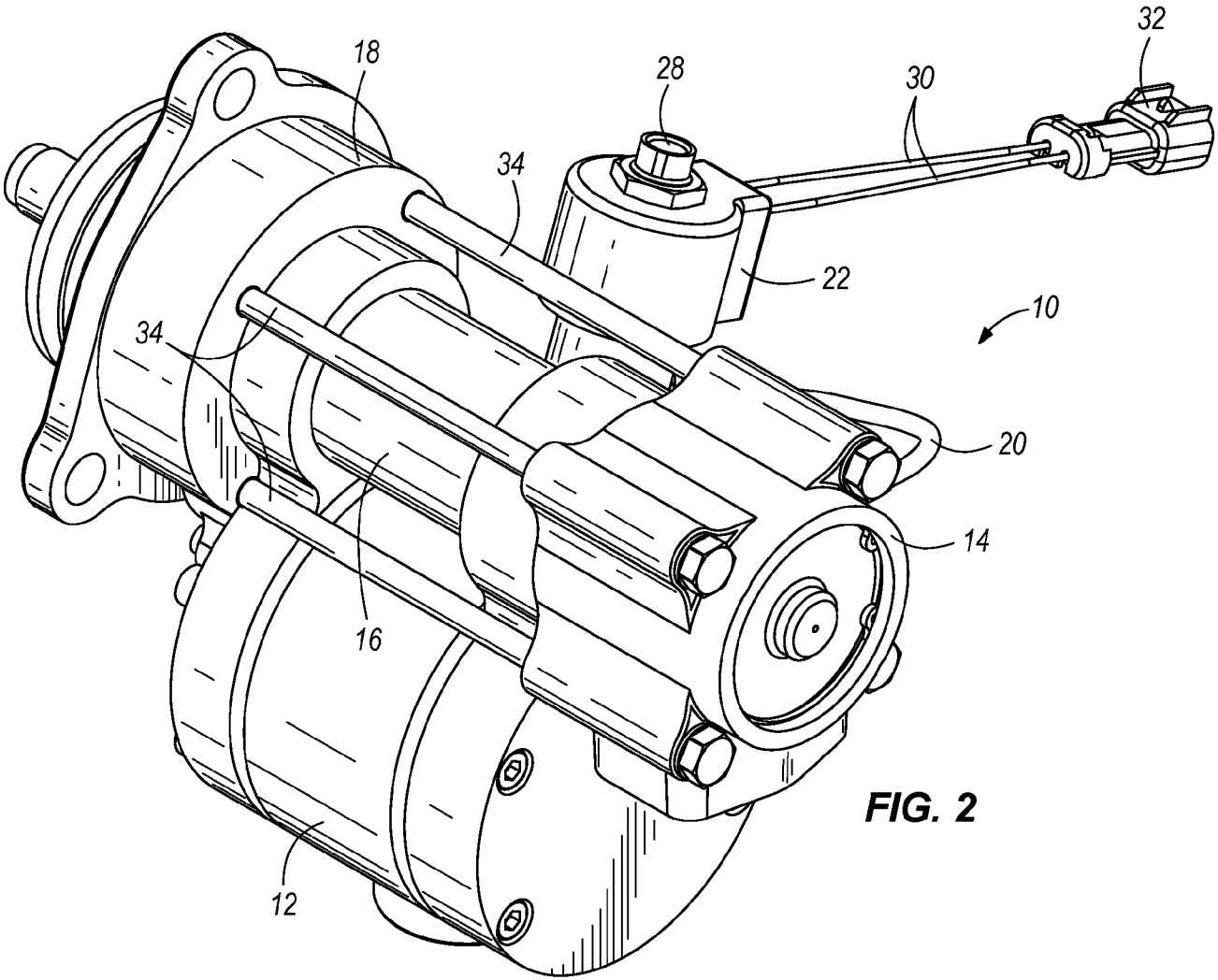
FIG. 2 is a second perspective view of the engine starter of FIG. 1.
Figure 3:
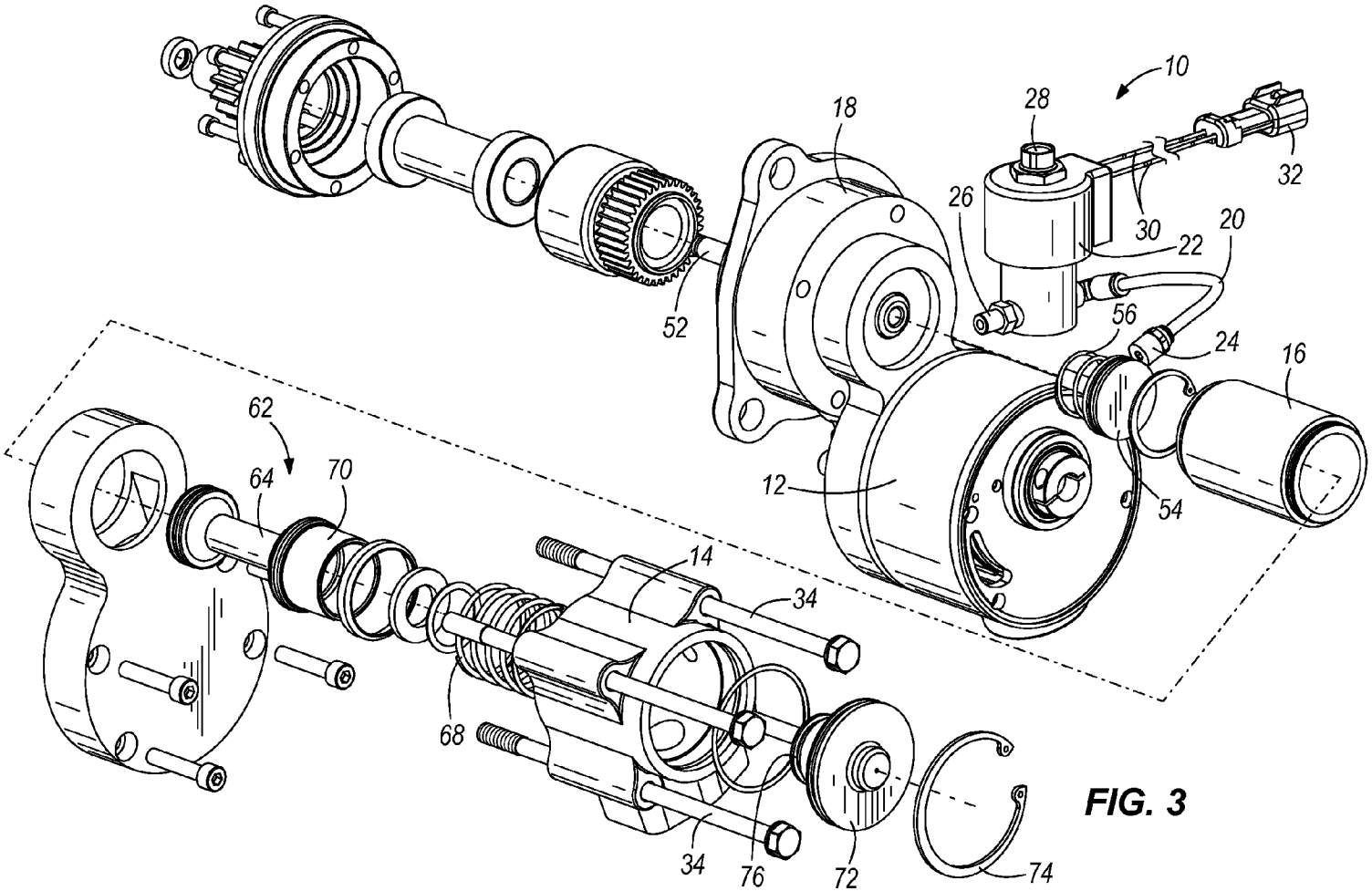
FIG. 3 is an exploded view of the engine starter of FIG. 2.

FIGS. 1-3 illustrate an engine starter 10 including a motor housing 12, a first chamber housing 14, a second chamber housing 16 and a gear train housing 18. The first chamber housing 14 is fluidly coupled to the second chamber housing 16 with a length of conduit 20 and a master valve 22. Fitting 24 is coupled between the first chamber housing 14 and the conduit 20 and fitting 26 is coupled between the second chamber housing 16 and the master valve 22. The master valve 22 permits fluid to flow between the first chamber housing 14 and the second chamber housing 16 when in an open position, and inhibits fluid flow between the first chamber housing 14 and second chamber housing 16 when in a closed position. The master valve 22 includes an exhaust 28 that permits the second chamber housing 16 to vent fluid to atmosphere when the master valve 22 is in the closed position. The master valve 22 further includes wires 30 connected to an actuator 32 to control the master valve 22. The illustrated actuator 32 includes a push button, but other actuators are possible, such as switches, knobs and the like. The actuator 32 is operable to turn the master valve 22 on and off by toggling between the open and closed positions, respectively. In one embodiment, the actuator 32 is coupled to a controller and one or more sensors that control operation of the master valve 22 in response to sensed pressure in one or both of the first and second chamber housings 14, 16.

A plurality of bolts 34 extend through the first chamber housing 14 and extend into the gear train housing 18 to couple the first chamber housing 14 to the gear train housing 18. The bolts 34 couple the motor housing 12, the first chamber housing 14, the second chamber housing 16, and the gear train housing 18 together. In another embodiment, other fasteners, rather than bolts, are utilized to retain the various components of the engine starter 10 together.

Figure 4:
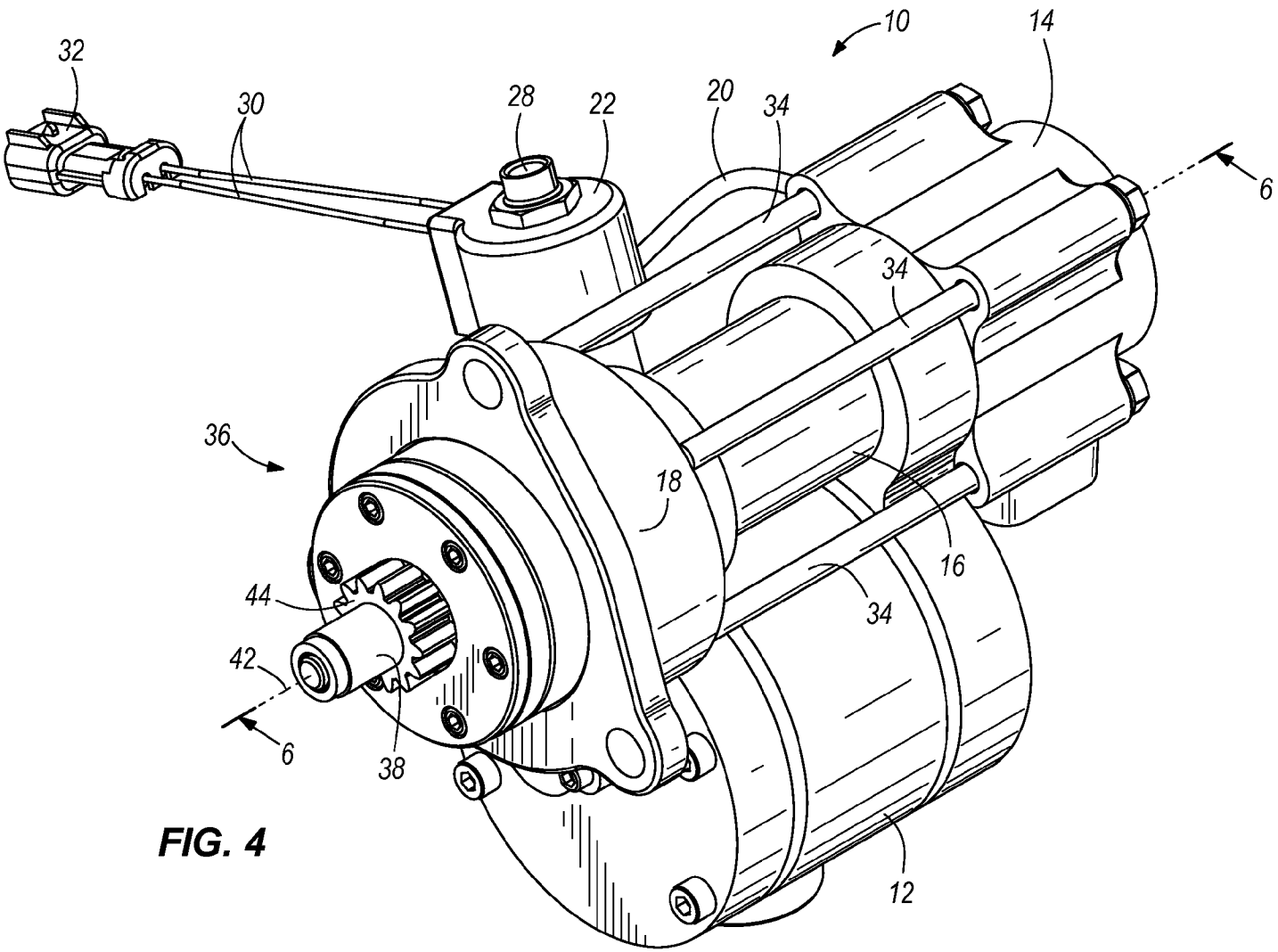
FIG. 4 is a third perspective view of the engine starter of FIG. 1.
Figure 5:
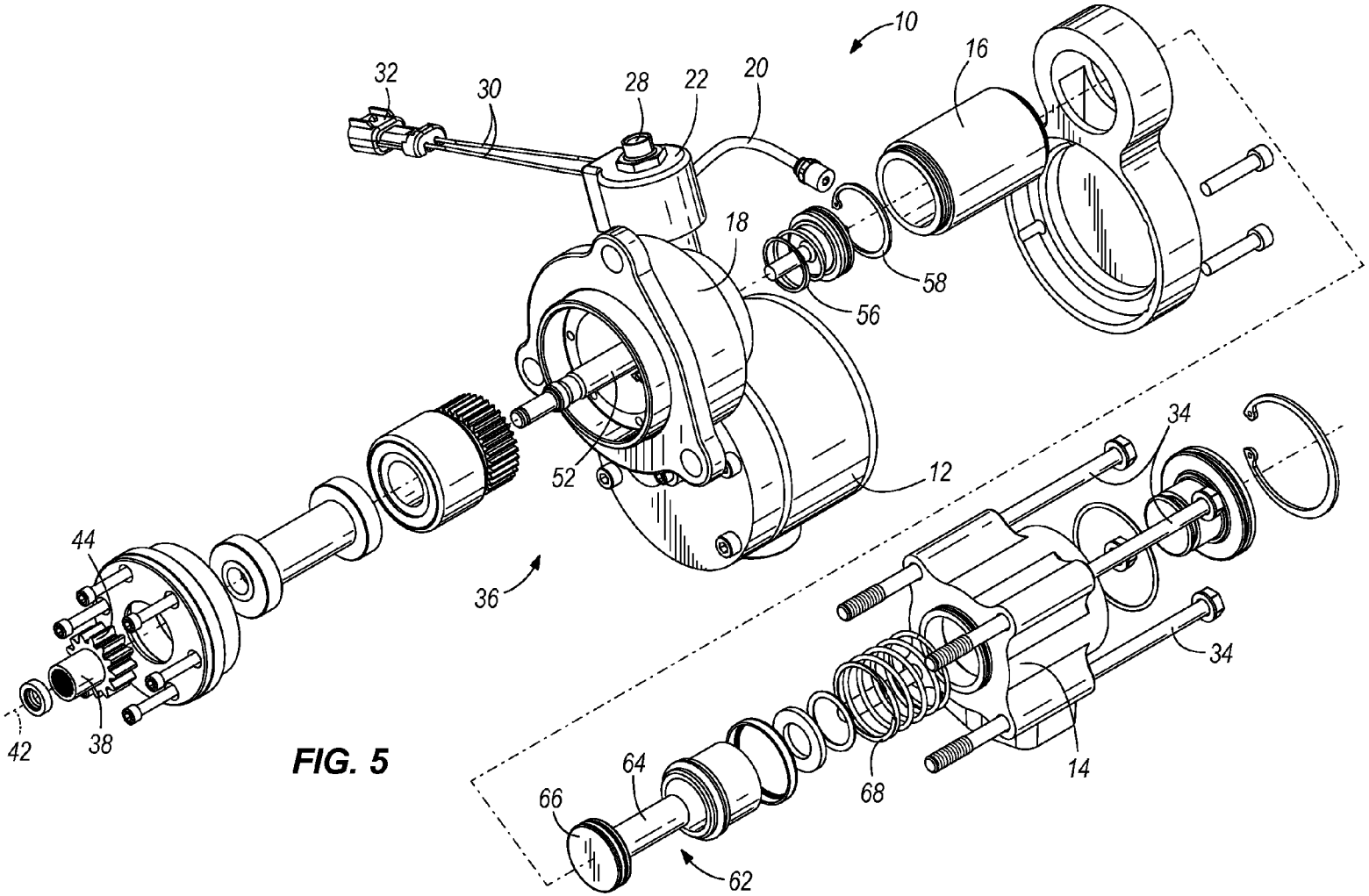
FIG. 5 is an exploded view of the engine starter of FIG. 4

FIGS. 4 and 5 illustrate a gear train 36 drivingly coupled to a pinion gear 38 that is rotatable about an axis 42. The pinion gear 38 includes a plurality of pinion teeth 44. A plurality of intermeshing gears are included in the gear train 36 to drivingly couple the pinion gear 38 to a motor 46 (see FIG. 6) positioned in the motor housing 12. The pinion gear 38 rotates in response to operation of the motor 46. Operation of the motor 46 will be described in more detail in the description of FIGS. 6-10.

FIGS. 6-10 illustrate the engine starter 10 in various positions and stages of operation. The engine starter 10 includes a first valve 50 having a first stem 52, a first working surface 54 and a first spring 56. The first spring 56 biases the first valve 50 against a first retaining ring 58 when the first valve 50 is in a retracted position (see FIG. 6). The first retaining ring 58 inhibits movement of the first valve 50 past the retracted position. The first stem 52 is an elongate member that extends between the first working surface 54 and the pinion gear 38. The first valve 50 is moveable linearly along the axis 42. The first valve 50 is in sealing engagement with an interior of the second chamber housing 16 and includes a first o-ring seal 60 between the first valve 50 and the second chamber housing 16.

The engine starter 10 further includes a second valve 62 having a second stem 64, a second working surface 66, and a second spring 68. The second valve 62 further includes a cylindrical protrusion 70 at an end of the second stem 64 opposite the end having the second working surface 66. An end cap 72 is retained in the first chamber housing 14 with a retaining ring 74. The end cap 72 includes a protruding portion 76. The cylindrical protrusion 70 telescopingly receives the protruding portion 76 to permit the second stem 64 to move along the axis 42. The cylindrical protrusion 70 sealingly engages the protruding portion 76 with a seal 78. The second spring 68 engages the end cap 72 and biases the second valve 62 into a closed position (shown in FIGS. 6, 7 and 9).

The cylindrical protrusion 70, the end cap 72, the protruding portion 76 and the first chamber housing 14 together define a motor supply chamber 80. The motor supply chamber 80 includes a fluid supply inlet 82 coupled to a source of fluid 84. A motor seal 86 is coupled for movement with the second valve 62. The motor seal 86 seals the second valve 62 against the motor supply chamber 80 when the second valve 62 is in the closed position (see FIGS. 6, 7 and 9) to inhibit fluid flow from the motor supply chamber 80 to the motor 46. When the second valve 62 moves into an open position (see FIGS. 8 and 10) the motor seal 86 unseats from the motor supply chamber 80 and permits fluid flow (represented by arrow 88) from the motor supply chamber 80 to the motor 46.

The second chamber housing 16, the first working surface 54 and the second working surface 66 together define an actuating chamber 90. The actuating chamber 90 includes a fluid inlet 92 to which is coupled the fitting 26. The master valve 22 permits fluid flow between the motor supply chamber 80 and the actuating chamber 90, when the master valve 22 is in the open position, and permits fluid flow between the actuating chamber 90 and the atmosphere when the master valve 22 is in the closed position. The actuating chamber 90 has a variable volume because the distance between the first working surface 54 and the second working surface 66 is variable.

The motor 46 includes a rotatable shaft 94 positioned in the motor housing 12. The rotatable shaft 94 rotates in response to flow of fluid (illustrated with arrow 88) operating on vanes. Rotation of the rotatable shaft 94 causes movement of gears in the gear train 36, which in turn causes rotation of the pinion gear 38 and first stem 52. The pinion gear 38 selectively abuts, engages and/or meshes with a bull gear 96, to selectively cause rotation of the bull gear 96. The pinion gear 38 is spaced from the bull gear 96 in FIG. 6, the pinion gear 38 is abutting the bull gear 96 in FIGS. 9 and 10, and the pinion gear 38 is in a meshing engagement with the bull gear 96 in FIGS. 7 and 8.

Figure 6:
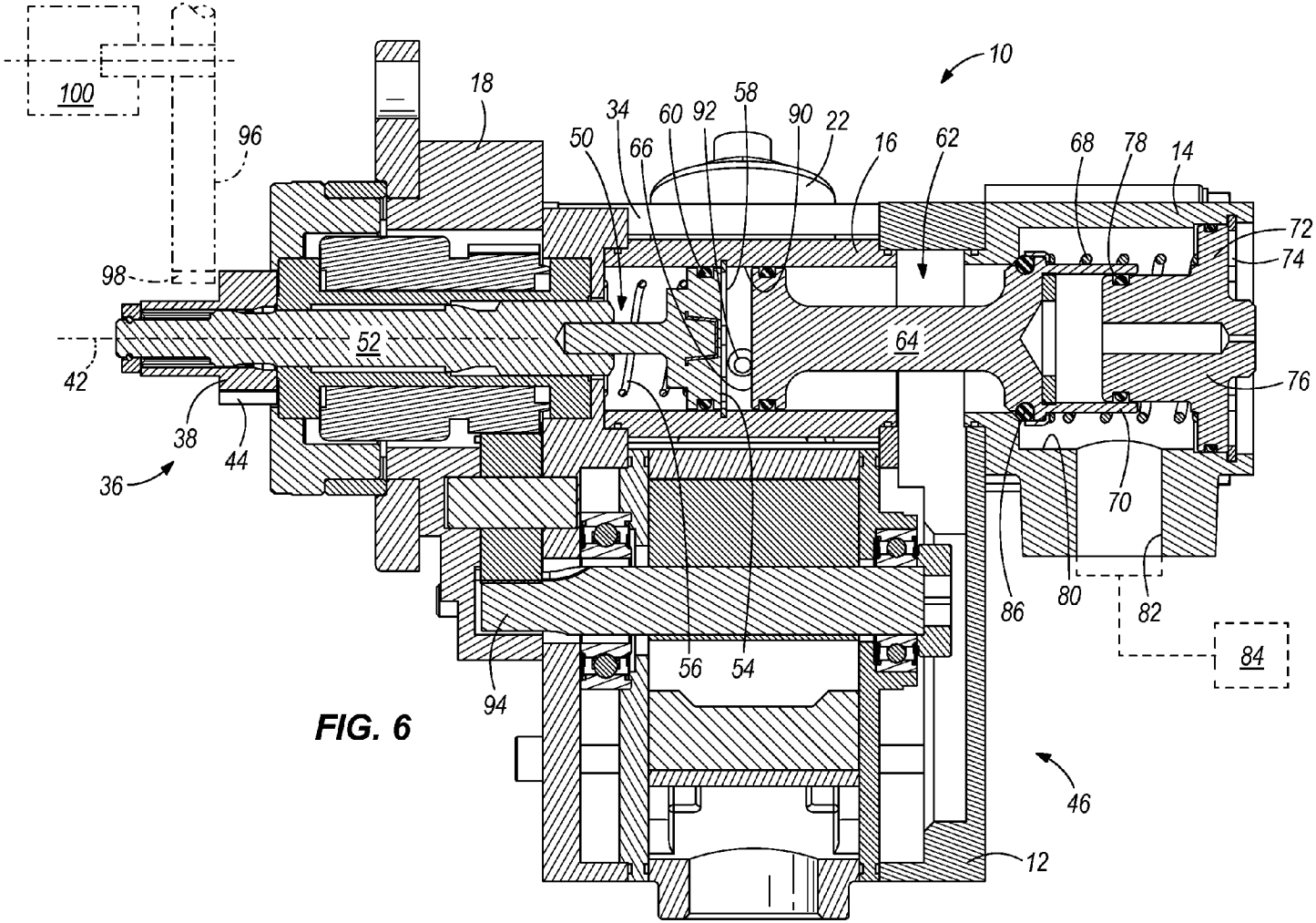
FIG. 6 is a cross-sectional view of the engine starter in an at-rest position and taken along line 6-6 of FIG. 4.

In operation, the engine starter 10 is shown in an at rest position in FIG. 6, in which the master valve 22 is in the closed position such that the actuating chamber 90 vents to atmosphere, the motor supply chamber 80 does not provide motive fluid to the source of fluid 84, and in which the pinion gear 38 is not rotating and is spaced from the bull gear 96. When is it desirable to start the engine 100, an operator actuates the actuator 32, which causes fluid to flow from the source of fluid 84 into the motor supply chamber 80, and the master valve 22 to open to permit fluid flow from the motor supply chamber 80 into the actuating chamber 90 through the conduit 20. Fluid flow into the actuating chamber 90 increases the pressure on the first working surface 54 and the second working surface 66 and therefore causes movement of the first valve 50 and/or the second valve 62 along the axis 42. In the illustrated embodiment, the first spring 56 has a lower spring constant than the second spring 68, to permit movement of the first valve 50 prior to movement of the second valve 62. In another embodiment, movement of the first valve 50 prior to movement of the second valve 62 can be accomplished by altering the relative surface areas of the first and second working surfaces 54, 66, and/or altering spring 56, 68 sizes, constants and other characteristics.

Figure 7:
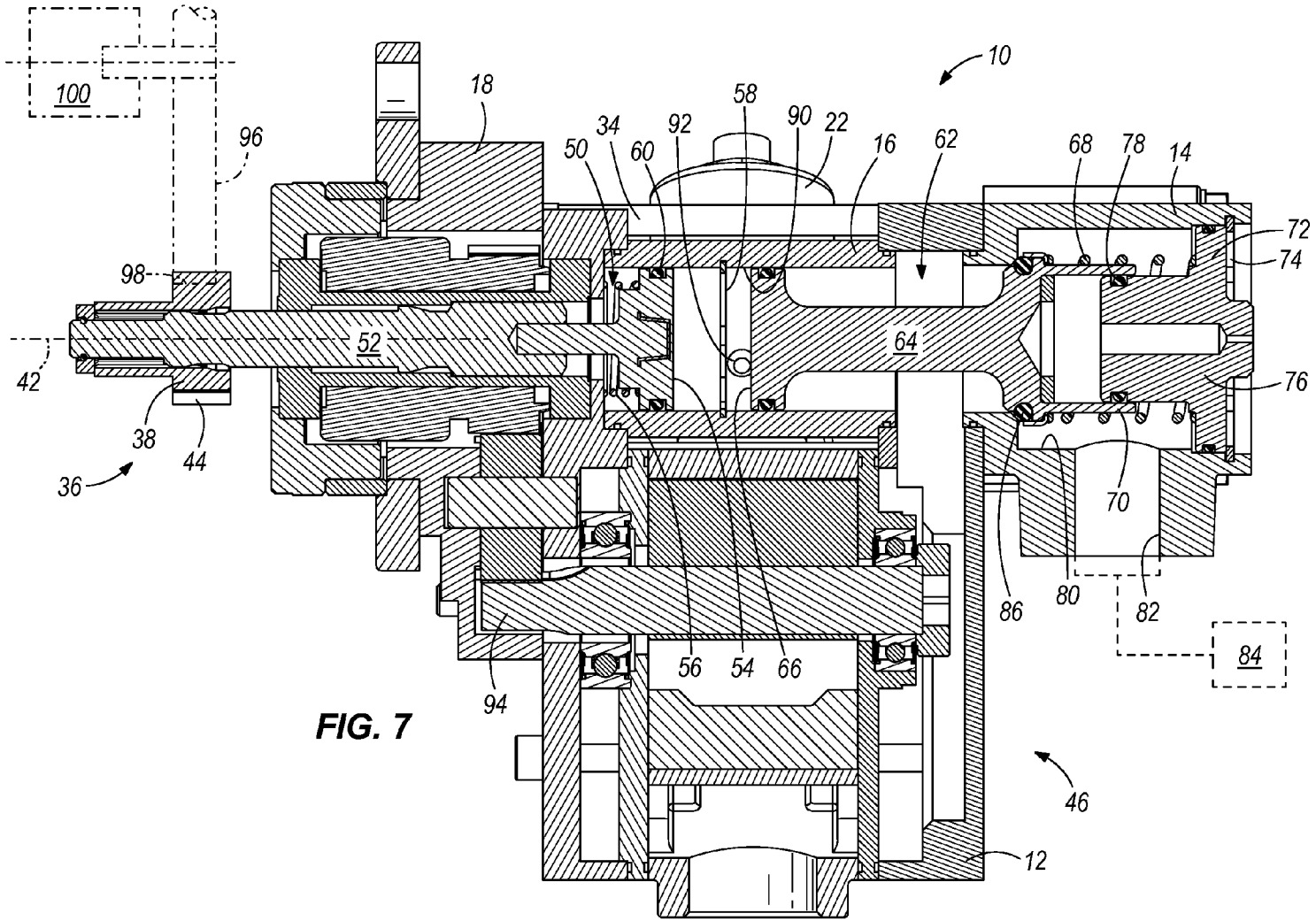
FIG. 7 is a cross-sectional view of the engine starter in a first operating position.

The pinion gear 38 moves with the first valve 50 toward the bull gear 96. If the pinion gear teeth 44 are in meshing alignment with teeth 98 on the bull gear 96, the pinion gear 38 moves into meshing engagement with the bull gear 96, as shown in FIG. 7. When the pinion gear 38 and the first valve 50 have reached the end of stroke (i.e. axial movement of the first valve 50 has ceased), pressure in the actuating chamber 90 acting on the working surface 66 gives rise to a force that moves the second valve 62 along the axis 42, see FIG. 8. When the second valve 62 moves, the motor seal 86 moves away from the first chamber housing 14, thereby permitting fluid to flow from the motor supply chamber 80 into the motor housing 12 as indicated with arrow 88. This fluid flow causes rotation of the rotatable shaft 94, and thereby operation of the gear train 36 and rotation of the pinion gear 38 and the shaft 52, see FIG. 8. Rotation of the pinion gear 38 causes rotation of the bull gear 96 and thereby starts operation of the engine 100.

Figure 8:
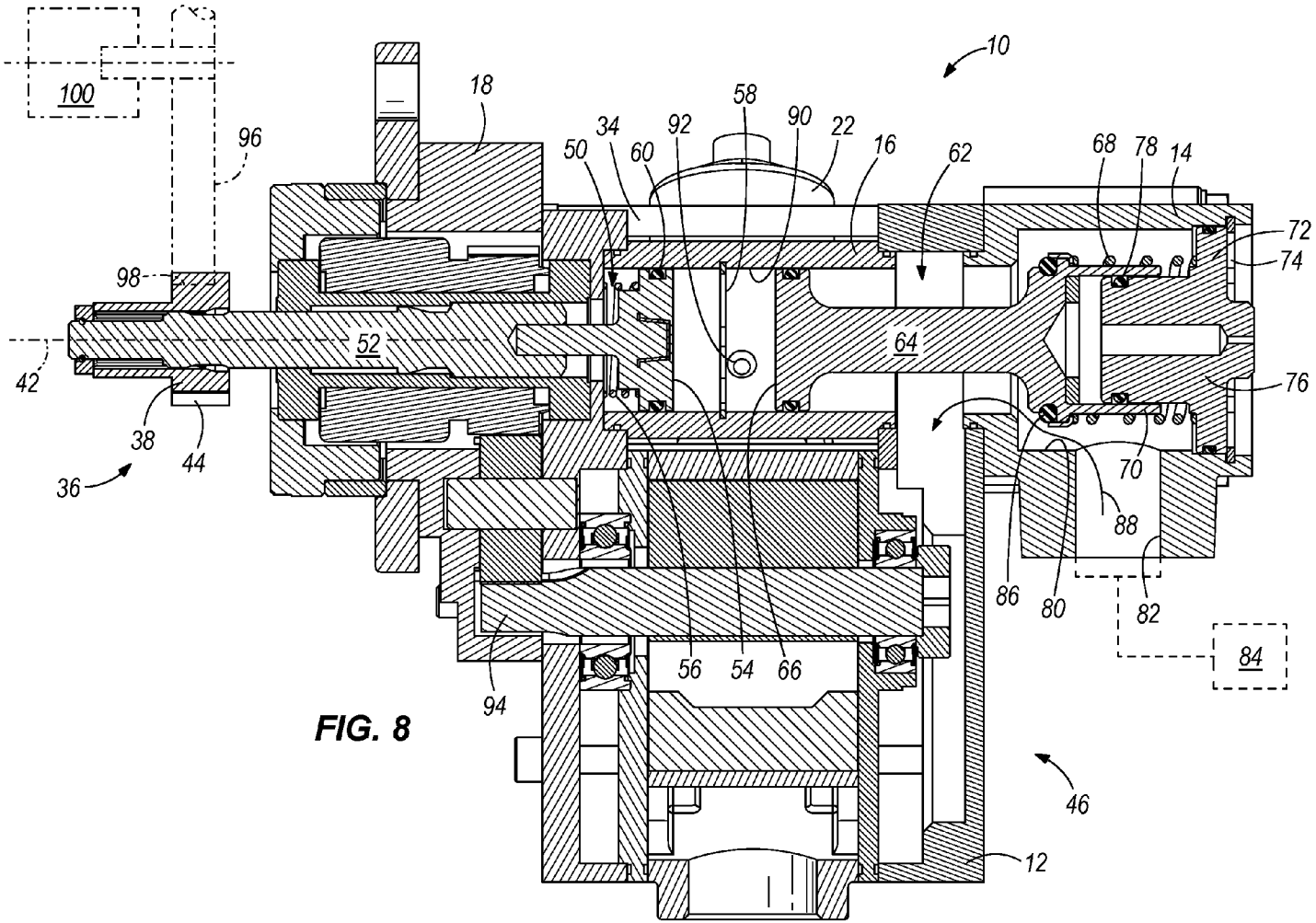
FIG. 8 is a cross-sectional view of the engine starter in a second operating position.

After the engine 100 has been started, the operator or control system turns the master valve 22 to the closed position and shuts off the flow of motive fluid to the motor supply chamber 80, such that the pinion gear 38 is permitted to return to the at rest position, see FIG. 6. The progression of FIG. 6-8 shows ideal operation of the engine starter 10.

Figure 9:
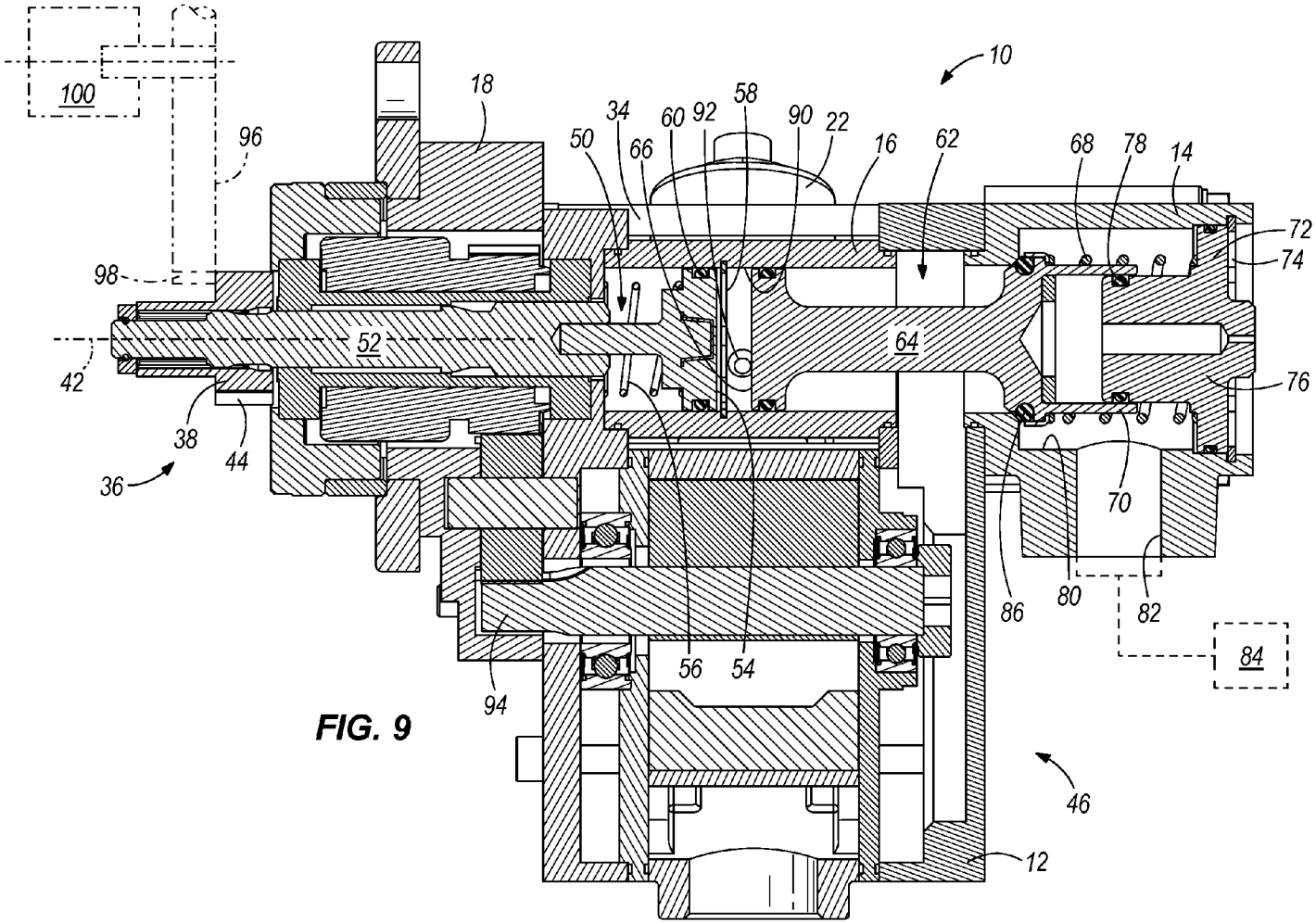
FIG. 9 is a cross-sectional view of the engine starter in a third operating position.
Figure 10:
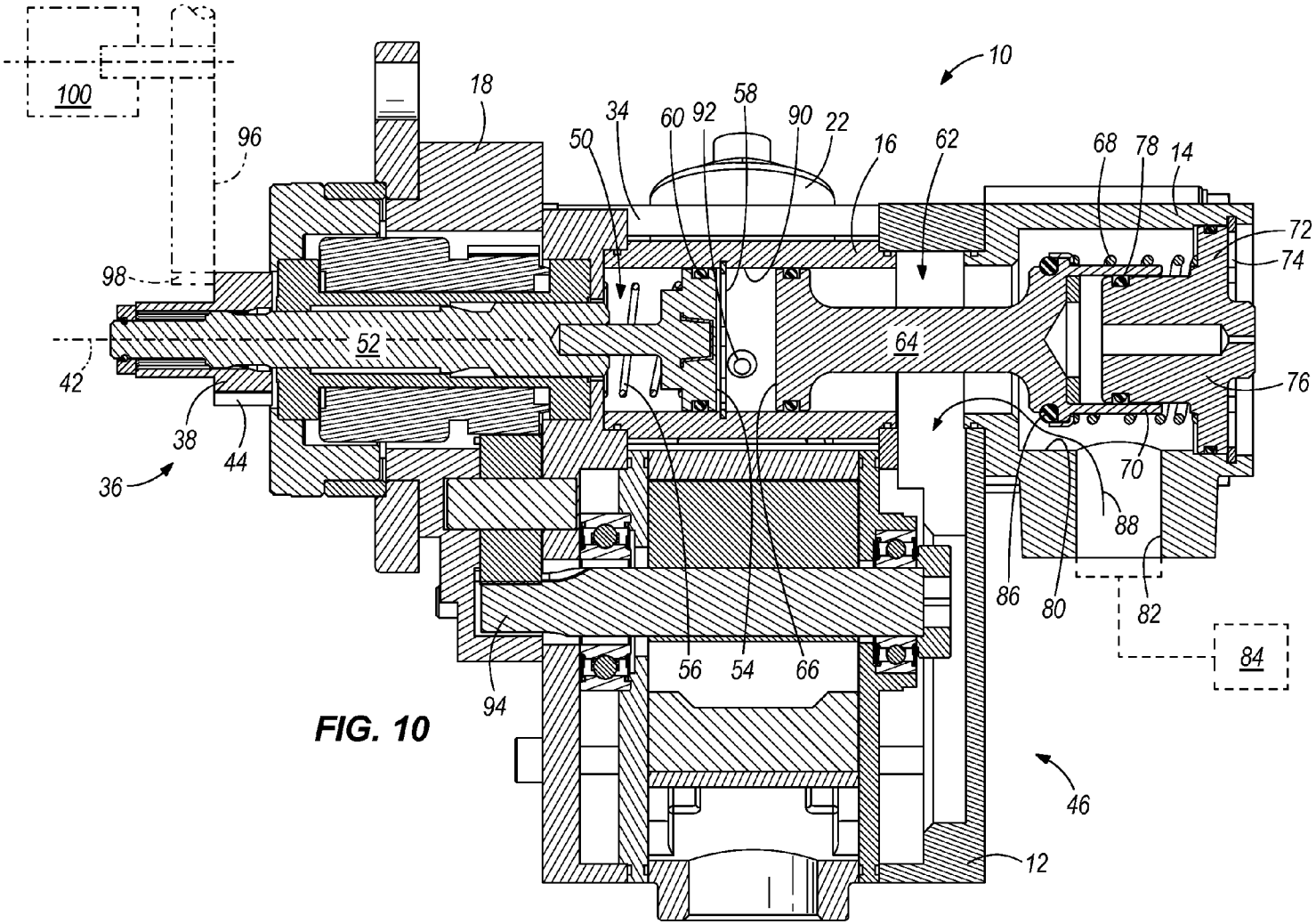
FIG. 10 is a cross-sectional view of the engine starter in a fourth operating position.

If the pinion gear teeth 44 are not in meshing alignment with the bull gear teeth 98, the pinion gear 38 abuts against the bull gear 96 in a partially extended position, as shown in FIG. 9. Movement of the first valve 50 is inhibited by the abutment (i.e. it prematurely reaches end of stroke and temporarily ceases axial movement), and pressure in the actuating chamber 90 increases to eventually move the second valve 62, as shown in FIG. 10. When the second valve 62 moves, the pinion gear 38 begins to rotate slowly. Rotation of the pinion gear 38 will move the pinion gear teeth 44 into meshing alignment with the bull gear teeth 98 and the pinion gear 38. When the pinion gear teeth 44 are in meshing alignment with the bull gear teeth 98, the first valve 50 is permitted to move the pinion gear 38 into meshing engagement with the bull gear 96, as shown in FIG. 8. When the pinion gear teeth 44 are in meshing engagement with the bull gera teeth 98, axial movement of the pinion gear 38 ceases, as the pinion gear 38 has reached the end of stroke. The pressure in the actuating chamber 90 momentarily drops when the pinion gear 38 moves into engagement with the bull gear 96, which in turn, momentarily slows rotation of the pinion gear 38 to facilitate moving the pinion gear 38 into meshing engagement with the bull gear 96. Fluid continues to flow into the motor supply chamber 80 and the actuating chamber 90 and causes rotation of the pinion gear 38 when the pinion gear 38 is in meshing engagement with the bull gear 96. Rotation of the pinion gear 38 causes rotation of the bull gear 96 and thereby starts operation of the engine 100. After the engine 100 has been started, the operator or control system turns the master valve 22 off and shuts off motive fluid supply, as discussed above.

In an alternative design, the spring constants of the first and second springs 56, 68 and/or surface areas of the first and second working surfaces 54, 66 are chosen to permit initial rotation of the pinion gear 38 as it approaches the bull gear 96, regardless of whether it would have meshed or abutted. The first valve 50 can move prior to movement of the second valve 62, after movement of the second valve 62, or the first and second valves 50, 62 can move simultaneously. In another embodiment, the first and second valves 50, 62 move simultaneously for a portion of the actuation and move sequentially for a portion of the actuation.

Various features and advantages of the invention are set forth in the following claims.

What is claimed is:

1. An engine starter operable to initiate operation of an engine under the influence of motive fluid from a motive fluid source, the engine starter comprising:

a motor operable in response to a flow of motive fluid;

a drive train coupled to the motor for operation with the motor;

a pinion coupled to the motor via the drive train for rotation about a pinion axis in response to operation of the motor;

a first valve having a first spring and a first moveable portion, the first moveable portion coupled to the pinion and moveable with the pinion along a first valve axis between a retracted position in which the pinion is spaced from the engine and an extended position in which the pinion engages a portion of the engine, wherein the first spring biases the first moveable portion into the retracted position; and a second valve having a second spring and a second moveable portion, the second valve positioned between the motive fluid source and the motor, the second moveable portion moveable along a second valve axis between a closed position in which communication between the motive fluid source and the motor is inhibited, such that the motor is not operating, and an open position in which communication between the motive fluid source and the motor is permitted, such that the motive fluid is permitted to flow through the motor to initiate operation of the motor and therefore rotation of the pinion, wherein the second spring biases the second moveable portion to the closed position;

wherein the first valve axis and the second valve axis are collinear;

wherein the first moveable portion moves from the retracted position to the extended position prior to movement of the second moveable portion from the closed position to the open position, such that the pinion moves along the axis prior to rotating about the axis.

2. The engine starter of claim 1, further comprising an actuating chamber positioned between the first moveable portion and the second moveable portion, wherein pressure in the actuating chamber is variable to move the first and second moveable portions in response to the pressure.

3. The engine starter of claim 2, further comprising a third valve coupled between the motive fluid source and the actuating chamber to permit fluid to flow from the motive fluid source to the actuating chamber when the third valve is open, such that pressure in the actuating chamber is greater than atmospheric pressure, and inhibiting flow of fluid from the motive fluid source to the actuating chamber and coupling the actuating chamber to exhaust when the valve is closed, such that pressure in the actuating chamber is substantially atmospheric pressure.

4. The engine starter of claim 3, wherein movement of the first moveable portion is initiated at a first pressure in the actuating chamber and movement of the second moveable portion is initiated at a second pressure in the actuating chamber, wherein the second pressure is greater in magnitude than the first pressure.

5. The engine starter of claim 1, wherein when the pinion moves from the retracted position to the extended position, pinion teeth abut engine teeth without meshing in a partially extended position, and rotation of the pinion permits the pinion teeth to mesh with and engage the engine teeth in a fully extended position.

6. The engine starter of claim 1, wherein first valve axis and the second valve axis are parallel to the pinion axis.

7. The engine starter of claim 1, wherein the first spring has a first spring constant and the second spring has a second spring constant, greater than the first spring constant.

8. The engine starter of claim 7, wherein the pinion axis is collinear with the first valve axis and the second valve axis.

9. A method of starting an engine with an engine starter, the method comprising:

pressurizing a motor supply chamber with a fluid;

selectively pressurizing an actuating chamber to an initial pressure in response to the pressure in the motor supply chamber;

moving a first valve along a first axis in response to pressure in the actuating chamber;

moving a pinion toward engagement with the engine in response to movement of the first valve;

further pressurizing the actuating chamber to a pressure above the initial pressure;

moving a second valve along a second axis in response to the further pressurizing the actuating chamber;

rotating the pinion in response to movement of the second valve;

meshing pinion teeth with teeth on the engine; and starting the engine in response to rotation of the pinion.

10. The method of claim 9, further comprising retracting the pinion from the engine after the engine has started operating.

11. The method of claim 9, wherein the second axis is oriented parallel to and collinear with the first axis.

12. The method of claim 9, wherein the first valve moves prior to movement of the second valve.

13. The method of claim 9, wherein the actuating chamber is pressurized in response to a master valve operating in an open condition and the actuating chamber not pressurized in response to the master valve operating in a closed condition.

14. The method of claim 9, wherein moving the second valve along the second axis opens a passage between the motor supply chamber and a turbine, such that the turbine rotates in response to the fluid from the motor supply chamber to cause rotation of the pinion.

15. The method of claim 9, further comprising stopping movement of the pinion in response to abutting the engine teeth without meshing with the engine teeth, wherein rotating the pinion clears the abutment of the pinion and engine teeth, to thereby permit meshing of the pinion teeth and the engine teeth.

16. The method of claim 9, wherein rotating the pinion comprises rotating the pinion at a first slow speed to permit the pinion teeth to mesh with the engine teeth and rotating the pinion at a second fast speed to initiate operation of the engine.

17. An engine starter operable to initiate operation of an engine under the influence of motive fluid from a source of motive fluid, the engine starter comprising:

a motor operable under the influence of the motive fluid to operate a gear train;

a motor supply chamber in constant communication with the source of motive fluid;

a first valve including a first working surface and a first stem extending along a first valve axis, the first valve being supported for movement along the first valve axis between retracted and extended positions;

a pinion coupled to the first valve, a first portion of the pinion being in meshing engagement with the gear train and a second portion of the pinion adapted to move out of engagement with respect to a portion of the engine in response to the first valve being in the retracted position and into engagement with respect to a portion of the engine in response to the first valve being in the extended position, the pinion rotating in response to the motor driving rotation of the gear train;

a second valve including a second working surface facing the first working surface and second stem extending along a second valve axis that is collinear with the first valve axis, the second valve being supported for movement along the second axis between open and closed positions;

a sealing member within the motor supply chamber and coupled for movement with the second valve, the sealing member closing communication between the motor supply chamber and the motor in response to the second valve being in the closed position, and opening communication between the motor supply chamber and the motor in response to the second valve being in the open position;

an actuating chamber at least partially defined by the first and second working surfaces;

a master valve operable between an open condition in which the master valve opens communication between the source of motive fluid and the actuating chamber, and a closed condition in which the master valve closes communication between the source of motive fluid and the actuating chamber and places the actuating chamber in communication with exhaust;

a first biasing member biasing the first valve toward the retracted position, the first biasing member deflecting in response to a first force applied to the first valve; and a second biasing member biasing the second valve toward the closed position, the second biasing member deflecting in response to a second force applied to the second valve, the second force being higher in magnitude than the first force;

wherein actuating the master valve into the open condition pressurizes the actuating chamber with motive fluid;

wherein exposure of the motive fluid to the first and second working surfaces initially gives rise to the first force on the first valve, resulting in deflection of the first biasing member and movement of the first valve from the retracted position toward the extended position;

wherein cessation of movement of the first valve toward the extended position and the pressure of motive fluid in the actuating chamber give rise to the second force against the second working surface, resulting in deflection of the second biasing member and movement of the second valve from the closed position toward the open position, such that the sealing member opens communication between the motor supply chamber and the motor; and wherein opening communication between the motor supply chamber and the motor causes the motor to operate under the influence of the motive fluid to drive rotation of the gear train and rotation of the pinion to initiate operation of the engine.

18. The engine starter of claim 17, wherein the master valve opens and closes communication between the motor supply chamber and the actuating chamber when in the open and closed conditions, respectively.

19. The engine starter of claim 17, wherein the second portion of the pinion includes pinion gear teeth adapted for meshing with engine teeth of the portion of the engine; wherein cessation of movement of the first valve toward the extended position arises from the pinion gear teeth abutting the engine teeth without meshing with the engine teeth prior to the first valve reaching the extended position; wherein initial operation of the motor causes rotation of the pinion to clear abutment of the pinion and engine teeth; wherein forces arising from motive fluid acting on the first working surface move the first valve into the extended position in response to the pinion teeth clearing abutment with the engine teeth such that the pinion teeth are placed in meshing engagement with the engine teeth.

20. The engine starter of claim 19, wherein the pinion rotates at a first slow speed when the pinion teeth abut the engine teeth to permit the pinion teeth to mesh with the engine teeth, and wherein the pinion rotates at a second fast speed when the pinion teeth mesh with the engine teeth to initiate operation of the engine.

* * * * *